US005868618A

United States Patent [19]

Netley et al.

[11] Patent Number: 5,868,618

[45] Date of Patent: Feb. 9, 1999

[54] POKER GAME METHOD

[75] Inventors: Neil J. Netley, 1615 Belford Rd., Reno, Nev. 89509; Dimo Ditchev, Reno, Nev.

[73] Assignee: Neil J. Netley, Reno, Nev.

[21] Appl. No.: 723,829

[22] Filed: Sep. 30, 1996

[51] Int. Cl.[6] ..... A63F 1/00

[52] U.S. Cl. ..... 463/13; 463/11; 273/292

[58] Field of Search ..... 273/292; 463/13, 463/16, 20, 25, 26, 27, 9, 10

[56] References Cited

U.S. PATENT DOCUMENTS 5,042,809 8/1991 Richardson ..... 463/25

5,123,649 6/1992 Tiberio ..... 273/143 R 5,531,440 7/1996 Dabrowski et al. ..... 273/292

5,544,892 8/1996 Breeding ..... 273/292

5,630,753 5/1997 Fuchs ..... 463/13

5,664,999 9/1997 Kurihara ..... 463/25

*Primary Examiner*—Jessica J. Harrison

*Assistant Examiner*—James Schaaf

*Attorney, Agent, or Firm*—Thomas R. Lampe

[57] ABSTRACT

A multi-tier video draw poker game in which a player can wager winnings from a first tier poker hand on a second tier poker hand.

7 Claims, 8 Drawing Sheets

| | 1st COIN | 2nd COIN | 3rd COIN | 4th COIN | 5th COIN |
|---|---|---|---|---|---|
| ROYAL FLUSH | 250 | 500 | 750 | 1000 | 4800 |
| STRAIGHT FLUSH | 50 | 100 | 150 | 400 | 450 |
| FOUR OF A KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 28 |
| THREE OF A KIND | 3 | 6 | 9 | 12 | 15 |
| TWO PAIR | 2 | 4 | 6 | 8 | 18 |
| JACKS OR BETTER | 1 | 2 | 3 | 4 | 5 |

TABLE 1. SUPER DRAW POKER HAND PROBABILITIES

| | SECOND HAND | | | | |
|---|---|---|---|---|---|
| FIRST HAND | ROYAL FLUSH | STRAIGHT FLUSH | FOUR OF A KIND | FULL HOUSE | FLUSH |
| ROYAL FLUSH | 0.00000006% | 0.00000019% | 0.00000575% | 0.00002775% | 0.00002750% |
| STRAIGHT FLUSH | 0.00000019% | 0.00000056% | 0.00001725% | 0.00008325% | 0.00008250% |
| FOUR OF A KIND | 0.00000575% | 0.00001725% | 0.00052900% | 0.00255300% | 0.00253000% |
| FULL HOUSE | 0.00002775% | 0.00008325% | 0.00255300% | 0.01232100% | 0.01221000% |
| FLUSH | 0.00002750% | 0.00008250% | 0.00253000% | 0.01221000% | 0.01210000% |
| STRAIGHT | 0.00002850% | 0.00008550% | 0.00262200% | 0.01265400% | 0.01254000% |
| THREE OF A KIND | 0.00018150% | 0.00054450% | 0.01669800% | 0.08058600% | 0.07986000% |
| TWO PAIR | 0.00031500% | 0.00094500% | 0.02898000% | 0.13986000% | 0.13860000% |
| JACKS OR BETTER | 0.00053500% | 0.00160500% | 0.04922000% | 0.23754000% | 0.23540000% |
| ALL OTHER HANDS | 0.00137875% | 0.00413625% | 0.12684500% | 0.61216500% | 0.60665000% |
| TOTAL | 0.00250000% | 0.00750000% | 0.23000000% | 1.11000000% | 1.10000000% |

TABLE 1. (CONTINUED)

| | SECOND HAND | | | | |
|---|---|---|---|---|---|
| FIRST HAND | STRAIGHT | THREE OF A KIND | TWO PAIR | JACKS OR BETTER | ALL OTHER HANDS |
| ROYAL FLUSH | 0.00002850% | 0.00018150% | 0.00031500% | 0.00053500% | 0.00137875% |
| STRAIGHT FLUSH | 0.00008550% | 0.000054450 | 0.00094500% | 0.00160500% | 0.00413625% |
| FOUR OF A KIND | 0.00262200% | 0.01669800% | 0.02898000% | 0.04922000% | 0.12684500% |
| FULL HOUSE | 0.01265400% | 0.08058600% | 0.13986000% | 0.23754000% | 0.61216500% |
| FLUSH | 0.01254000% | 0.07986000% | 0.13860000% | 0.23540000% | 0.60665000% |
| STRAIGHT | 0.01299600% | 0.08276400% | 0.14364000% | 0.24396000% | 0.62871000% |
| THREE OF A KIND | 0.08276400% | 0.52707600% | 0.91476000% | 1.55364000% | 4.00389000% |
| TWO PAIR | 0.14364000% | 0.91476000% | 1.58760000% | 2.69640000% | 6.94890000% |
| JACKS OR BETTER | 0.24396000% | 1.55364000% | 2.69640000% | 4.57960000% | 11.80210000% |
| ALL OTHER HANDS | 0.62871000% | 4.00389000% | 6.94890000% | 11.80210000% | 30.41522500% |
| TOTAL | 1.14000000% | 7.26000000% | 12.60000000% | 21.40000000% | 55.15000000% |

*Fig. 6*

TABLE 2. DRAW POKER HAND PROBABILITIES

| | |
|---|---|
| ROYAL FLUSH | 0.0025% |
| STRAIGHT FLUSH | 0.0075% |
| FOUR OF A KIND | 0.2300% |
| FULL HOUSE | 1.1100% |
| FLUSH | 1.1000% |
| STRAIGHT | 1.1400% |
| THREE OF A KIND | 7.2600% |
| TWO PAIR | 12.6000% |
| JACKS OR BETTER | 21.4000% |
| ALL OTHER HANDS | 55.1500% |
| TOTAL | 100.0000% |

*Fig. 7*

TABLE 4. DRAW POKER HAND FREQUENCIES

| | |
|---|---|
| ROYAL FLUSH | 40,000.00 |
| STRAIGHT FLUSH | 13,333.33 |
| FOUR OF A KIND | 434.78 |
| FULL HOUSE | 90.09 |
| FLUSH | 90.91 |
| STRAIGHT | 87.72 |
| THREE OF A KIND | 13.77 |
| TWO PAIR | 7.94 |
| JACKS OR BETTER | 4.67 |
| ALL OTHER HANDS | 1.81 |

*Fig. 9*

TABLE 3. SUPER DRAW POKER HAND FREQUENCIES

| | SECOND HAND | | | | |
|---|---|---|---|---|---|
| FIRST HAND | ROYAL FLUSH | STRAIGHT FLUSH | FOUR OF A KIND | FULL HOUSE | FLUSH |
| ROYAL FLUSH | 1,600,000,000.00 | 533,333,333.33 | 17,391,304.35 | 3,603,603.60 | 3,636,363.64 |
| STRAIGHT FLUSH | 533,333,333.33 | 177,777,777.78 | 5,797,101.45 | 1,201,201.20 | 1,212,121.21 |
| FOUR OF A KIND | 17,391,304.35 | 5,797,101.45 | 189,035.92 | 39,169.60 | 39,525.69 |
| FULL HOUSE | 3,603,603.60 | 1,201,201.20 | 39,169.60 | 8,116.22 | 8,190.01 |
| FLUSH | 3,636,363.64 | 1,212,121.21 | 39,525.69 | 8,190.01 | 8,264.46 |
| STRAIGHT | 3,508,771.93 | 1,169,590.64 | 38,138.83 | 7,902.64 | 7,974.48 |
| THREE OF A KIND | 550,964.19 | 183,654.73 | 5,988.74 | 1,240.91 | 1,252.19 |
| TWO PAIR | 317,460.32 | 105,820.11 | 3,450.66 | 715.00 | 721.50 |
| JACKS OR BETTER | 186,915.89 | 62,305.30 | 2,031.69 | 420.98 | 424.81 |
| ALL OTHER HANDS | 72,529.47 | 24,176.49 | 788.36 | 163.35 | 164.84 |

TABLE 3. (CONTINUED)

| | SECOND HAND | | | | |
|---|---|---|---|---|---|
| FIRST HAND | STRAIGHT | THREE OF A KIND | TWO PAIR | JACKS OR BETTER | ALL OTHER HANDS |
| ROYAL FLUSH | 3,508,771.93 | 550,964.19 | 317,460.32 | 186,915.89 | 72,529.47 |
| STRAIGHT FLUSH | 1,169,590.64 | 183,654.73 | 105,820.11 | 62,305.30 | 24,176.49 |
| FOUR OF A KIND | 38,138.83 | 5,988.74 | 3,450.66 | 2,031.69 | 788.36 |
| FULL HOUSE | 7,902.64 | 1,240.91 | 715.00 | 420.98 | 163.35 |
| FLUSH | 7,974.48 | 1,252.19 | 721.50 | 424.81 | 164.84 |
| STRAIGHT | 7,694.68 | 1,208.25 | 696.18 | 409.90 | 159.06 |
| THREE OF A KIND | 1,208.25 | 189.73 | 109.32 | 64.36 | 24.98 |
| TWO PAIR | 696.18 | 109.32 | 62.99 | 37.09 | 14.39 |
| JACKS OR BETTER | 409.90 | 64.36 | 37.09 | 21.84 | 8.47 |
| ALL OTHER HANDS | 159.06 | 24.98 | 14.39 | 8.47 | 3.29 |

*Fig. 8*

POKER GAME METHOD

TECHNICAL FIELD

This invention relates to a draw poker game suitable for use in casinos and other gaming establishments.

BACKGROUND OF THE INVENTION

Games based upon draw poker have attained enormous popularity as casino-type entertainment games; particularly in the last couple of decades. The success of draw poker is at best partially based on the game's simplicity, i.e., there is widespread public knowledge of the game rules. Furthermore, technological innovations in computer gaming equipment, reasonably fair odds to the draw poker player with payouts typically in the 95% range, and a steady generation of revenue to casinos by draw poker contribute to the game's popularity.

However, a substantial limitation to a still broader expansion of draw poker in casino operations results from the relatively small number of winning combinations and relatively high hit frequency of the highest ranked reward, the Royal Flush (approx. every 40,000 hands), when compared to another popular casino gambling device, the slot machine.

Many variations of draw poker have been developed. Each of these game variations features its own set of rules and/or optimal player strategy. Some game variations attempt to increase the total game outputs and are represented by games such as "Deuces Wild Poker," "Joker Wild Poker," "Bonus Poker," "Double Bonus Poker," "Second Chance Poker," etc.). Others appeal to players by raising the payout percentage to 97% and even higher through the approach of providing bonuses for certain types of winning hands, such as Four of a Kind of Aces, Twos, Threes, etc.

DISCLOSURE OF INVENTION

This invention relates to a multi-tier video poker game method including the step of receiving payment from an individual and randomly dealing a first tier poker hand on a video screen observable by the individual.

The method additionally includes enabling the individual to play the first tier poker hand in consideration for said payment.

Criteria are established for a winning hand and the individual is awarded a payment credit if the first tier poker hand played by the individual meets or exceeds the criteria for a winning hand. The method further includes the step of enabling the individual to selectively either accept payment in an amount equal to or less than the payment credit or to wager the amount on a second tier poker hand to be displayed on the video screen.

Other features, advantages, and objects of the present invention will become apparent with reference to the following description and accompanying drawings.

BRIEF DESCRIPTION OF DRAWINGS

FIG. 6 is a table showing probabilities of hitting combinations of hands utilizing the teachings of the present invention.

FIG. 7 is a table of standard draw poker hand probabilities.

FIG. 8 is a table showing the inverse of FIG. 6 or frequencies of combinations.

FIG. 9 is a table showing the inverse of FIG. 7.

BEST MODE FOR CARRYING OUT THE INVENTION

The draw poker method of the present invention increases the number of outcomes by incorporating or interlocking two poker games into one game. Utilizing the method, which for purposes of illustration may be referred hereinafter as Super Draw Poker, a substantial increase in the game outputs is achieved, i.e. nine winning hands plus one losing hand multiplied by nine winning hands and one losing hand. The resulting probabilities are shown in FIG. 6, while FIG. 7 provides the probabilities of a standard draw poker game for comparison. FIGS. 8 and 9 respectively provide another way of distinguishing the particularities of the Super Draw Poker method versus standard draw poker, by showing the inverse of these probabilities, the poker hand frequencies.

The method of the present invention affords opportunities for fine-tuning the game outcomes and player rewards. Because the Super Draw Poker method is a direct offspring from the standard draw poker game, Super Draw Poker inherits its simplicity. Here simplicity means clarity, relying on public awareness of draw poker game rules. This promotes fast learning of the game of the present invention and prompt enjoyment of its gambling and entertainment attributes. While Super Draw Poker appeals to the player by giving him the opportunity to accumulate and be awarded bigger jackpots, it is a game with appeal to casinos as well, providing a steady, reasonable edge.

The Super Draw Poker game or method is implemented on a conventional draw poker computer driven, video display machine that is suitably programmed. The game proceeds in two stages that are easily distinguished on the screen. This serves to capitalize on a player's familiarity with the standard draw poker game, eliminate complications that may arouse confusion in the player, and also facilitate a smooth transition to the new game. A representative set of particular screen displays of the game during various phases thereof is shown in FIGS. 1–5.

Figure 1:
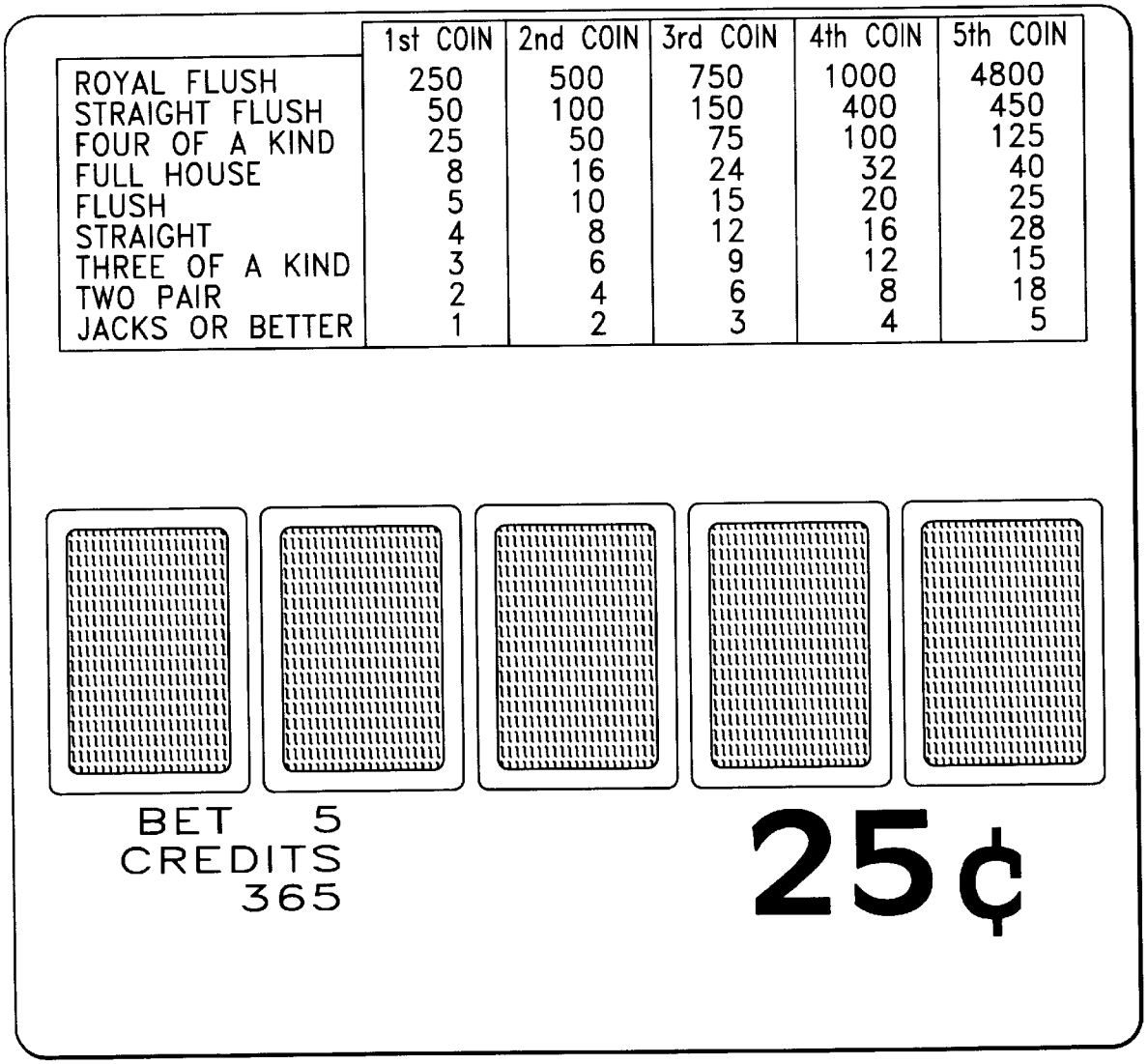
FIG. 1 is a representation of a video screen displaying information and cards employed when practicing the method of the present invention before a hand is dealt.
Figure 2:
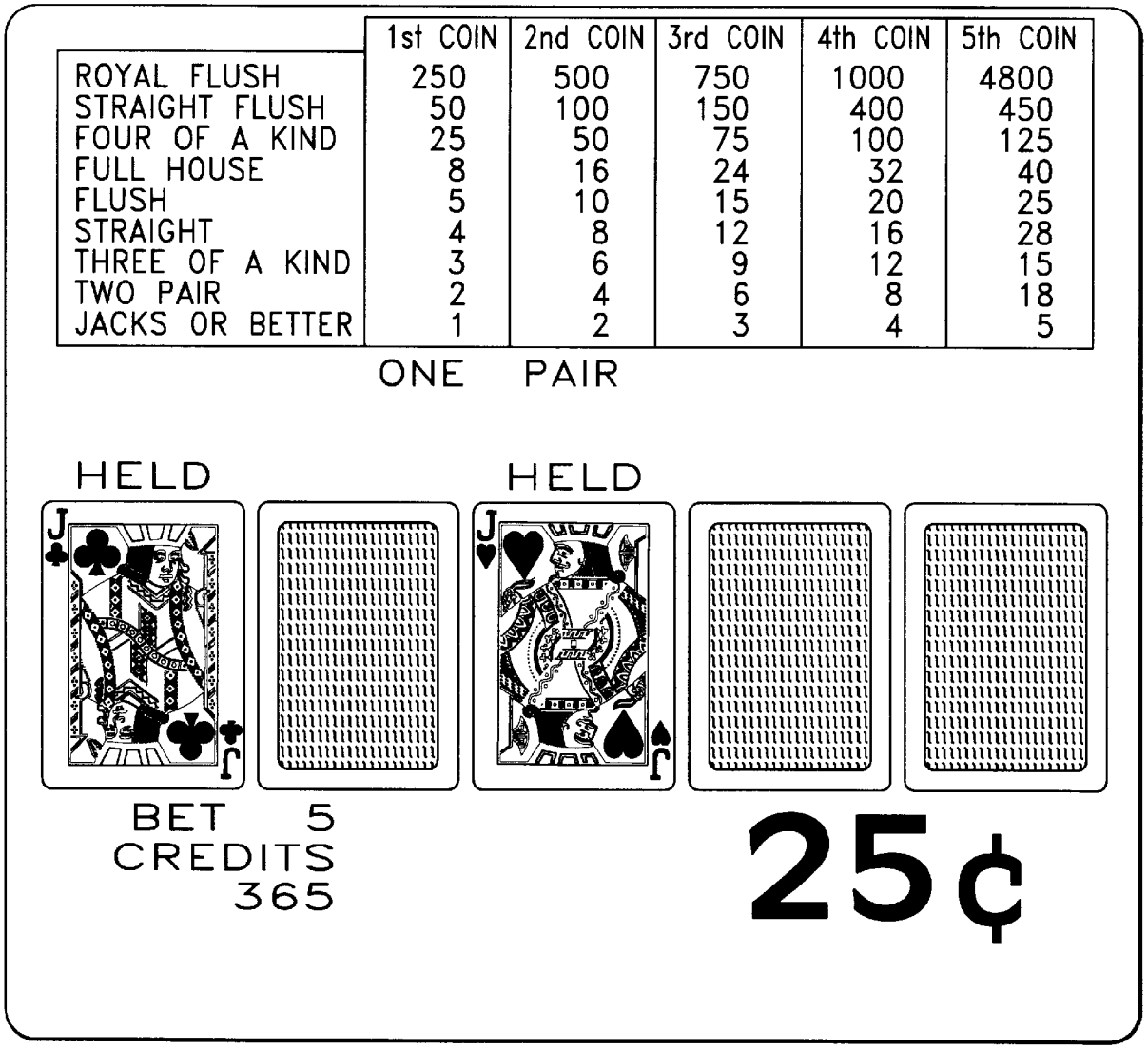
FIG. 2 is a representation of a video screen displaying two cards selected and the others to be replaced from the remaining cards.

In the first stage, the game falls perfectly into the standard draw poker format. When the player places a bet, a standard deck of fifty-two cards ranging upward from 2, 3, 4, 5, 6, 7, 8, 9, 10, J, Q, K, A, with or without Jokers, is randomly shuffled and five cards are dealt on the screen (FIG. 1). Now the player can hold from zero to five cards from this hand (FIG. 2) and draw additional cards from the deck to replace those discarded. This forms the final hand (FIG. 3) of the first game tier which is evaluated with the winning hands ranking in the same order as in a standard draw poker game: One Pair, Two Pairs, Three of a Kind, Straight, Flush, Full House, Four of a Kind, Straight Flush, and Royal Flush.

Figure 3:
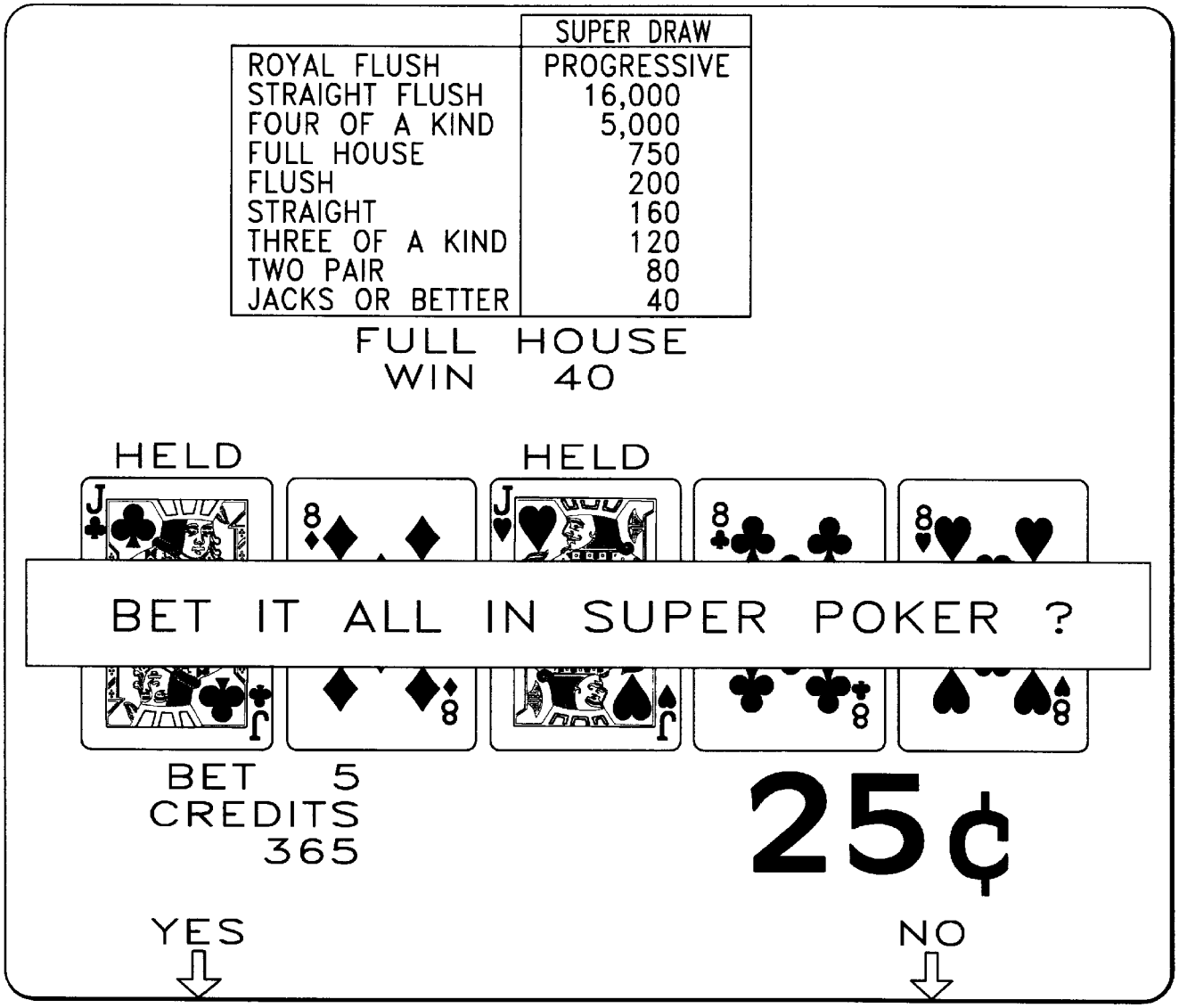
FIG. 3 is a representation of a video screen display with a win indicated and giving the player the opportunity to continue on into a second tier game.
Figure 4:
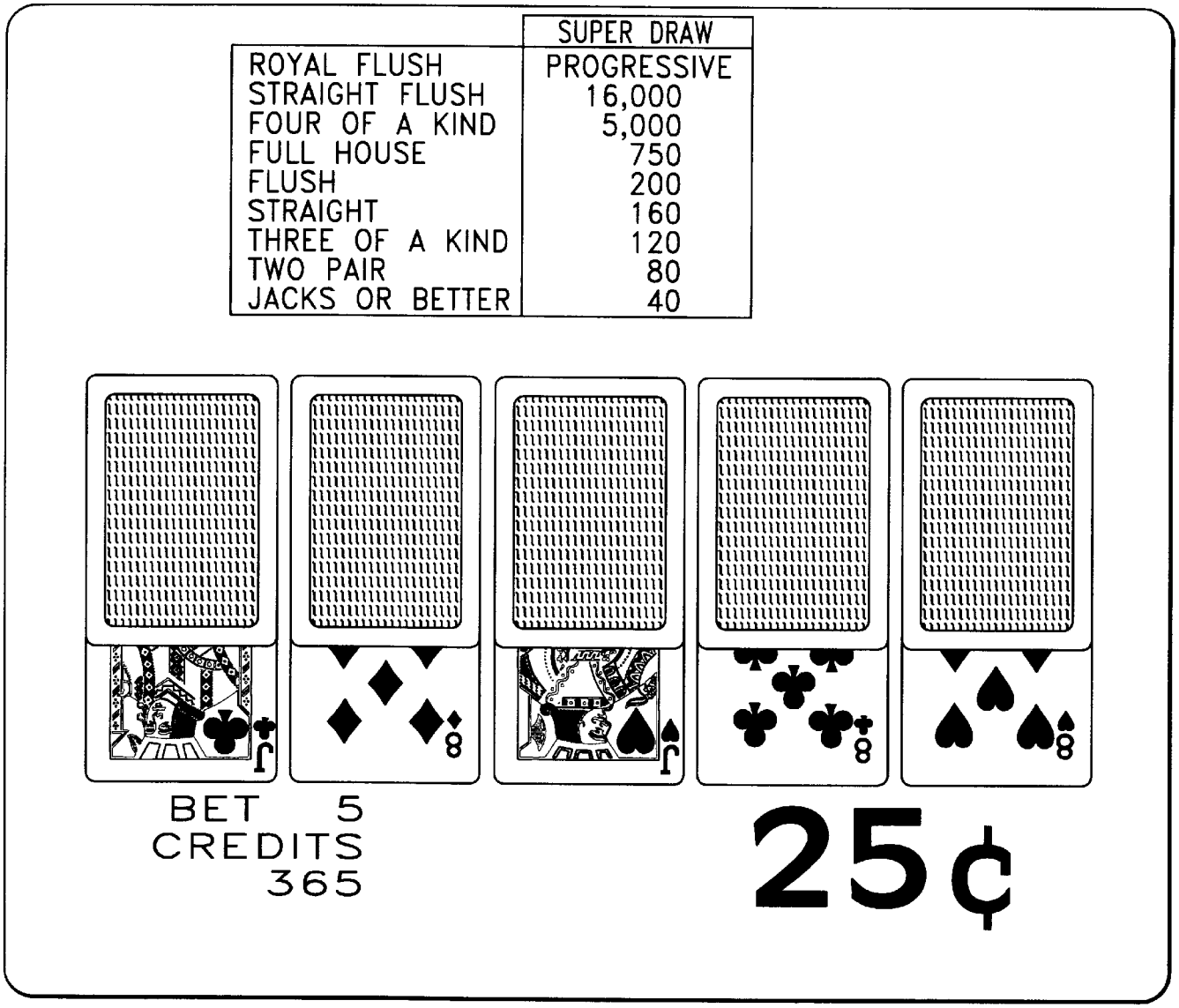
FIG. 4 is a representation of a video screen display of a second tier game.

In the event of a winning final hand (spanning from a minimum winning pair to Royal Flush) in the first tier hand, the player is prompted to draw a hand from a second, entirely independent and randomly shuffled deck (FIG. 3). This marks the beginning of the second stage or tier of the Super Draw Poker game. At this point, the player may take the entire amount of his winnings and forgo the option for the second hand drawing, or proceed with the second game tier and wager his winnings. The awards from the first card drawing (cards drawn in the first game tier) will equate to conventional draw poker awards or winnings. That is, if the player chooses not to elect and play the second tier game, the game reduces to an ordinary draw poker game with no difference in the odds or the performance either to the casino or to the player. It can be viewed as a Push option.

If the player chooses to play the second tier hand the entire win from the first draw or tier of the game is wagered. When a winning pair or better is drawn in the first hand, the player is prompted on the video screen (FIG. 3) to wager the win from this hand on a second tier hand. A second deck is randomly shuffled and five cards are dealt to the player. The backs of the cards in the second deck have different color and pattern (FIG. 4) to clearly indicate that the player has advanced to the second stage. This is believed not only to improve the player's visual perception but also to add to his excitement.

Figure 5:
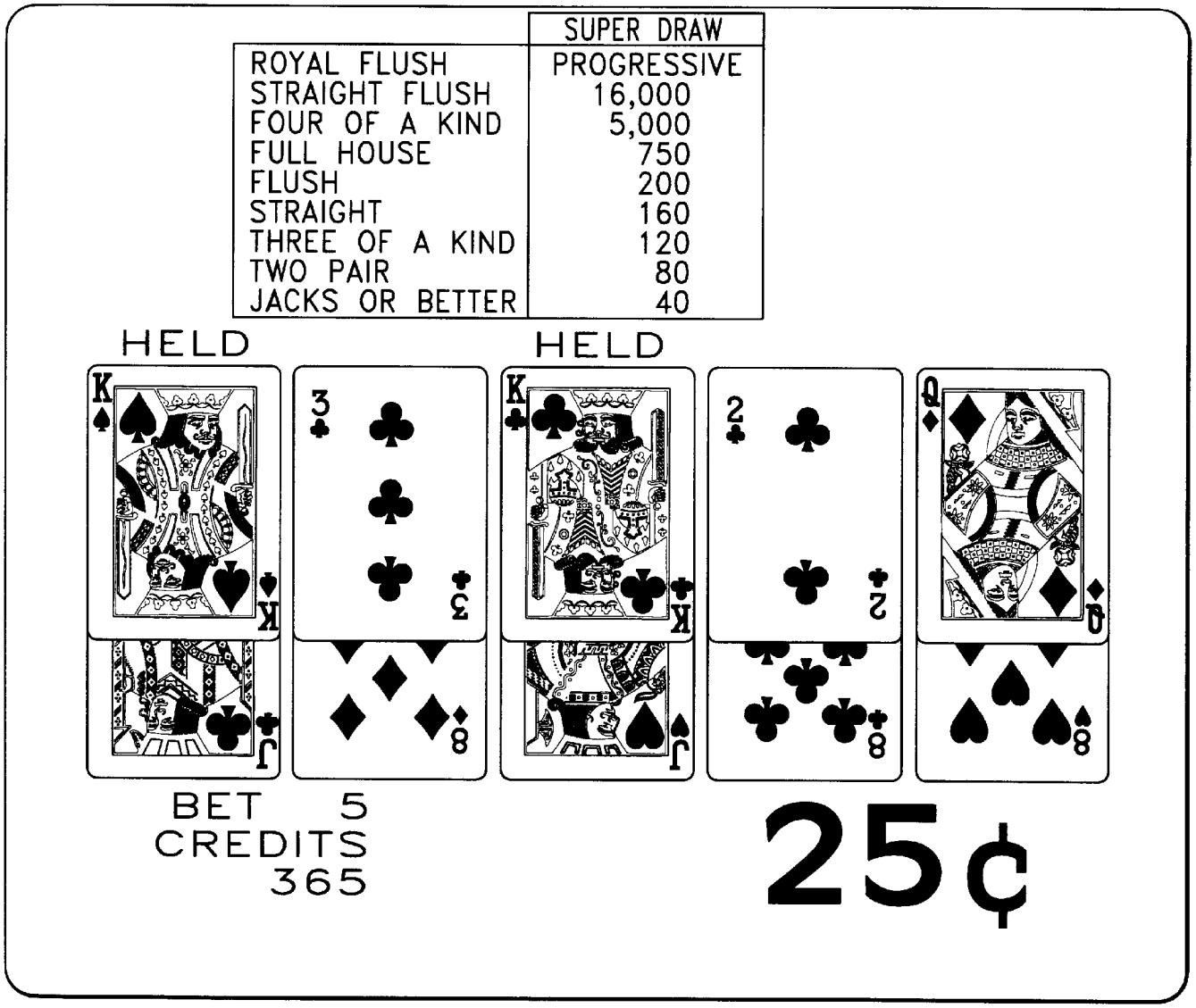
FIG. 5 is a representation of a video screen display of a completed second tier game.

The player can hold again from zero to five cards from this hand and draw from the deck to replace the discarded cards. The final hand is formed and evaluated again with the same winning hands ranking (FIG. 5). In the game that results from the two independent tier hands, the probabilities set forth in Table 1 (FIG. 6) take effect. They are supplemented by appropriate tables or awards (Pay Tables) that in general are more generous than that of a standard draw poker game. See FIG. 10. Progressive jackpots for Royal Flush and Straight Flush, and bonuses for Four of a Kind, Full House or Flush in the first hand, if provided, are included in the wager to advance to the second tier. The overall game hold percentage ranks and competes with the popular draw poker games such as those known in the gaming industry as Joker Wild Poker and Bonus Poker.

When the first deck produces a non-winning final hand, there is no advancement to the second tier or hand. This will speed up the game time frame, an important commercial consideration. It will also save the player the embarrassment of playing redundant non-winning hands. By limiting second tier advancement to certain conditions, such as a requirement that first tier hands be of a certain minimum value, i.e. Three of a Kind, the pace of the game will be further advanced. It is expected that overall time of the game incorporating the method of the present invention will be generally comparable to standard draw poker video games.

Obviously, other modifications and variations of the present invention are possible in light of the above teachings. It is therefore to be understood that within the scope of the appended claims, the invention may be practiced other than as specifically described.

We claim:

1. A multi-tier video poker game method comprising the steps of:

receiving payment from an individual;

randomly dealing a first tier poker hand on a video screen observable by the individual;

enabling the individual to play said first tier poker hand in consideration for said payment;

establishing criteria for a winning hand;

awarding a payment credit to the individual if the first tier poker hand played by the individual meets or exceeds the criteria for a winning hand; and enabling the individual to selectively either accept payment in an amount equal to or less than said payment credit or to wager said amount on a second tier poker hand displayed on said video screen.

2. The method according to claim 1 wherein said first tier poker hand and said second tier poker hand are draw poker hands, said method including the step of enabling the individual to draw additional cards when playing said first tier poker hand and said second tier poker hand.

3. The method according to claim 1 including the step of ending play if the individual fails to meet or exceed the criteria for a winning hand.

4. The method according to claim 1 including the step of paying a cash payment to the individual if the individual has wagered said amount on the second tier poker hand and said second tier poker hand is a winning hand meeting or exceeding the criteria for a winning hand.

5. The method according to claim 4 wherein the cash payment for a winning second tier poker hand exceeds the payment credit for a corresponding winning first tier poker hand for the same wagered amount.

6. The method according to claim 1 including the step of requiring said individual to wager the entire amount of the payment credit when wagering said amount on a second tier hand.

7. The method according to claim 1 wherein said first and second tier hands are displayed in different colors on said video screen.

* * * * *